US005927114A

United States Patent [19]

Berry

[11] Patent Number: 5,927,114

[45] Date of Patent: Jul. 27, 1999

[54] VIEW LIMITING ENCLOSURE ASSEMBLY FOR DIAL COMBINATION LOCKS

[76] Inventor: Daniel Berry, 8028 Wichita St. Lot 62, Fort Worth, Tex. 76140

[21] Appl. No.: 08/858,366

[22] Filed: May 19, 1997

[51] Int. Cl.[6] ..... E05B 1/00

[52] U.S. Cl. ..... 70/332; 70/333 A; 70/443; 70/445; 70/DIG. 58

[58] Field of Search ..... 70/333 A, 445, 70/333 R, 330–332, 334, 442–446, 158, 305, 306, 309, DIG. 56, DIG. 58, DIG. 43, DIG. 59; 292/171

[56] References Cited

U.S. PATENT DOCUMENTS

| | | | |
|---|---|---|---|
| 1,652,897 | 12/1927 | Hill | 70/333 A |
| 1,722,621 | 7/1929 | Bennett | 292/171 X |
| 2,020,879 | 11/1935 | Eldred | 70/333 A |
| 3,835,680 | 9/1974 | Evans | 70/333 A X |
| 4,080,757 | 3/1978 | Westerman | 292/171 X |
| 4,197,726 | 4/1980 | Uyeda | 70/333 A X |
| 4,404,823 | 9/1983 | Miller et al. | 70/333 A |
| 5,003,802 | 4/1991 | Beatty et al. | 70/333 A |

*Primary Examiner*—Lloyd A. Gall

[57] ABSTRACT

A view limiting enclosure and assembly for dial combination locks with a dome cover(9): which completely covers a dial combination lock(1): dial turning knob(3): and dial except for a dial viewing hole(10): to view the dial graduations as they go by a partly transparent L shaped cover(6): which covers the dial inside the dome cover so that only 3 or 4 dial graduations are seen at one time and all but one dial graduation mark looks the same. A rope pulling hole(11): in the side of the dome cover contains a rope(2): that goes around the dial turning knob and is used to turn the dial by pulling on one end or the other end of the rope slowly and counting one dial graduation at a time until the correct combination is reach to open lock. It takes one minute to open sober, very hard if not impossible, to open if you are drunk.

1 Claim, 3 Drawing Sheets

VIEW LIMITING ENCLOSURE ASSEMBLY FOR DIAL COMBINATION LOCKS

BACKGROUND

1. Field of Invention

This invention relates to dial combination locks, specifically to make them very hard to open if you are drunk.

2. Background and Objects of the Invention

The present invention relates to dial combination locks, particularly to making the locks very hard, if not impossible, to open if you are drunk.

This invention might be used by someone who drinks too much alcohol and then drives an automobile. This invention can be welded on or fitted over a common dial combination lock which has a steel shackle. It might be used with a chain wrapped tightly around the steering wheel and steering column and locked to keep the steering wheel from turning.

Someone who gets one or more drunk driving tickets might be ordered by a judge to use this lock or maybe a law would require this person to use this lock on their automobile. Such a law should require that the lock could not be preset to open by turning the dial just a few graduations. One object of the present invention is to do just that. Such a law should require that when the lock was in use that the rope with one knot on it was pulled all the way against rope pulling hole. This way you can not preset the lock when sober and later when drunk,open it by turning the dial just a few graduations. The law might require that persons required to use this lock have some kind of marking on their automobile license plate so that if the lock was not in use someone could call the police and report it. Perhaps a reward might be offered.

When testing this lock I found that I could open it sober in less then one minute. After drinking alcohol I found that the more I drank the harder it was to open the lock until I got to the point I could not open it at all. I was still able to open a common dial combination lock,very easy. Earlier U.S. Pat. No. 4,404,823 to Miller and Evans and U.S. Pat. No. 4,197,726 to Uyeda have covered dials and could simply use a dial with only one graduation mark different from the rest of the graduation marks with no numbers and would be somewhat like the present invention. These locks would still be easy to open compared to the present invention because the rope slips a little every once in a while. This slippage makes it pointless to mark the rope so that it would be easy to open. You could, however, mark an exposed dial or have a pre-marked cap that could fit tightly over an exposed dial to make it quick and easy to open, which we do not want. Finally on an exposed dial you could preset the dial so that after you get drunk you only have to turn the dial a few graduation marks to open it. On the present invention you can't preset the dial if the law requires you to have the rope with one knot up against rope pulling hole when in use.

Other objects, advantages and capabilities of the present invention will become apparent from the following detailed description, taken in conjunction with the accompanying drawings illustrating a preferred embodiment of the invention.

DRAWING FIGURES

REFERENCE NUMERALS IN DRAWINGS

Figure 2:
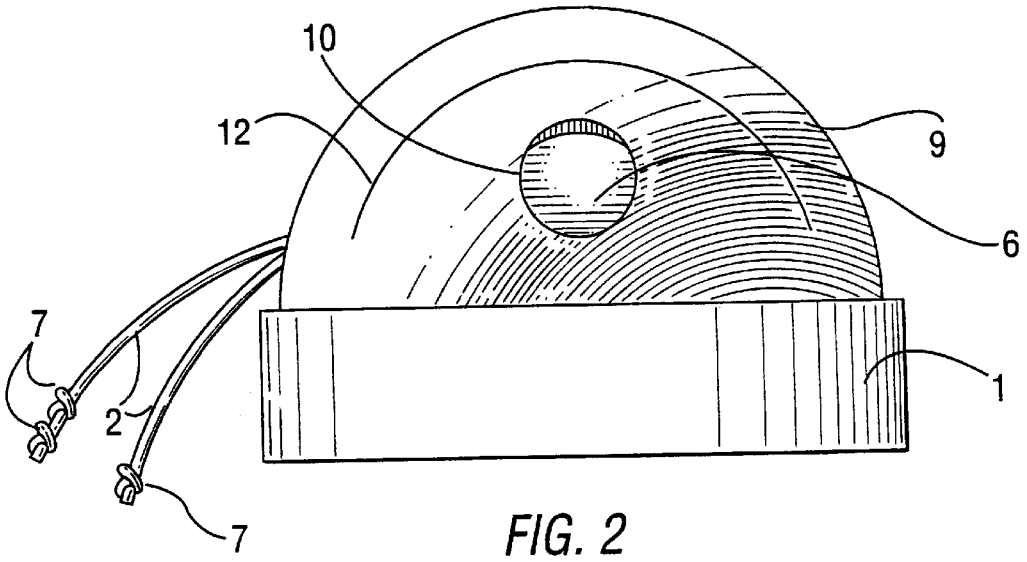
FIG. 2 is a top view of a dial combination lock with the present invention mounted on it.

1 dial combination lock
2 rope
3 dial turning knob
4 washer
5 wide line on dial
6 L shaped dial cover
7 knot in rope
8 reference point arrow
9 dome cover
10 viewing hole
11 rope pulling hole
12 groove slot
13 weld point

DESCRIPTION OF A PREFERRED EMBODIMENT

Figure 1:
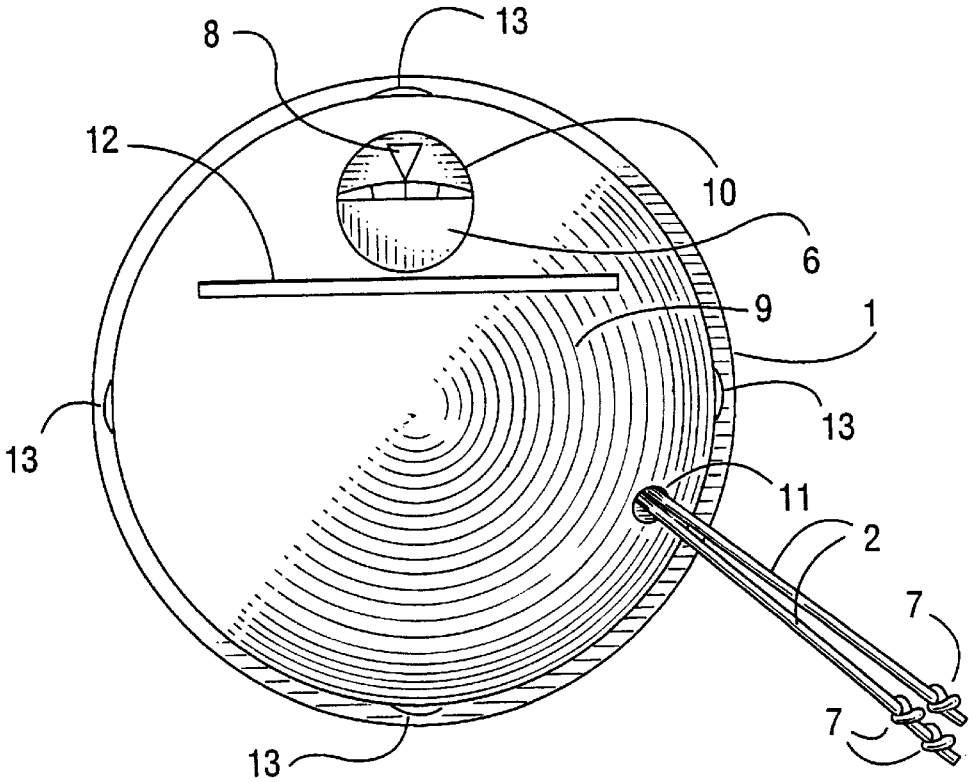
FIG. 1 is a front view of a dial combination lock with the present invention mounted on it.
Figure 3:
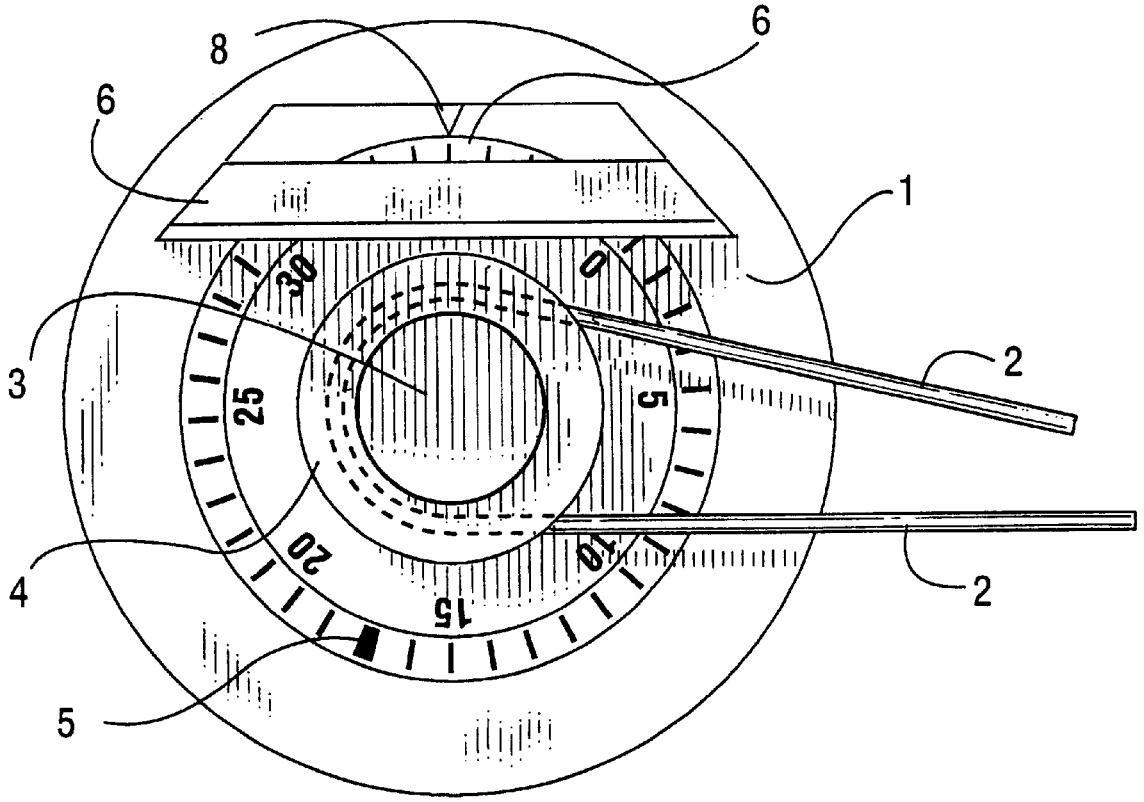
FIG. 3 is a front view of a dial combination lock with present invention with the dome cover removed.
Figure 5:
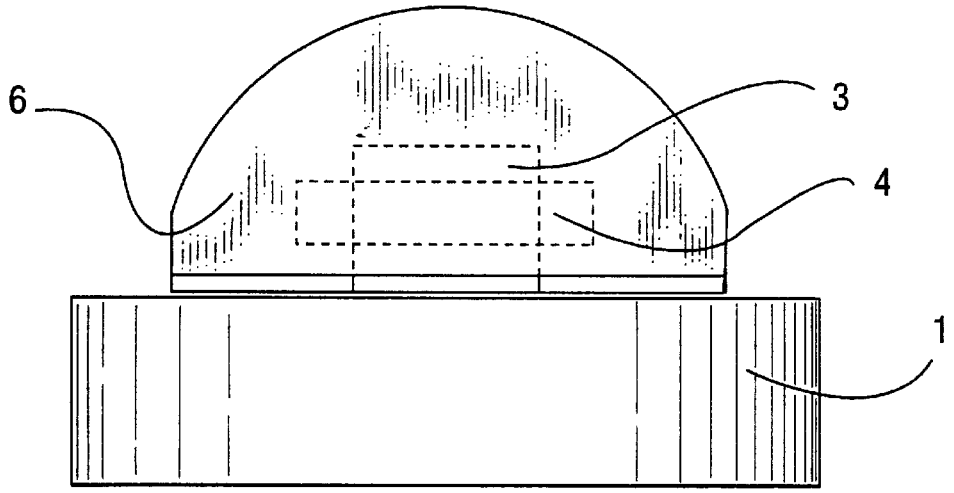
FIG. 5 is a top view of a dial combination lock with the present invention with both the dome cover and the rope removed.
Figure 4:
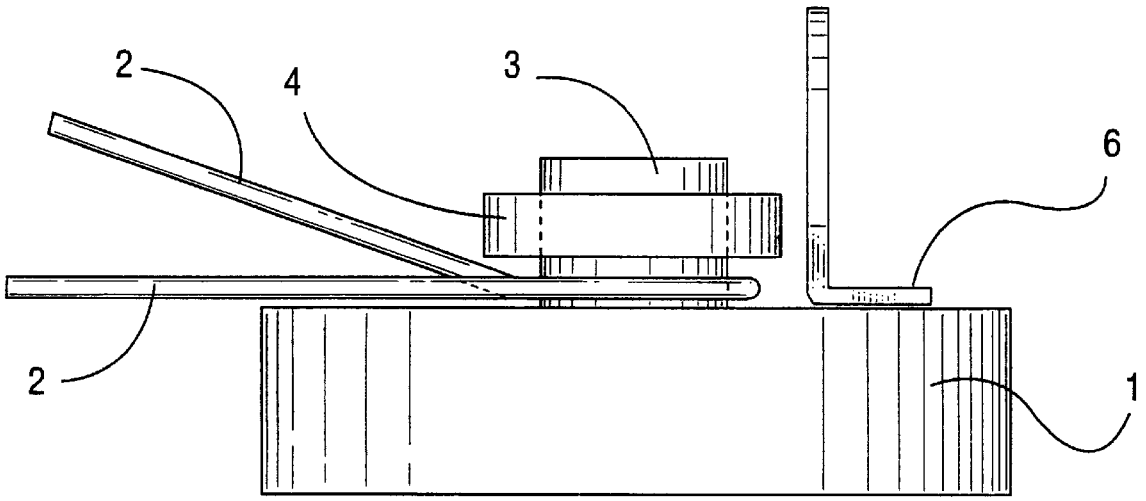
FIG. 4 is a side view of a dial combination lock with the present invention with the dome cover removed.

Referring to the drawings, wherein like reference characters designate corresponding parts throughout the several figures, a dial combination lock 1 is indicated by reference character 1 shown in FIGS. 1,2,3,4, and 5 on which a rope 2 shown in FIGS. 1,2,3, and 4, is used to turn a dial turning knob 3, shown in FIGS. 3,4, and 5, either clockwise by pulling on rope 2 which has a single knot 7, shown in FIGS. 1 and 2, or counter-clockwise by pulling on rope 2 which has 2 knots 7 on it. The rope 2 is pulled through a rope pulling hole 11, shown in FIG. 1. The knots 7 keep the rope 2 from going inside hole 11. The rope 2 is held place by a rubber hose washer 4, shown in FIGS. 3,4, and 5 and also held in place by a L shaped cover 6, shown in FIGS. 1,2,3,4, and 5, which is held in place by a groove slot 12, shown in FIGS. 1 and 2. A dome cover 9, shown in FIGS. 1 and 2, is welded at 4 weld points 13, shown in FIG. 1, onto the dial combination lock 1. Looking into a view hole 10, shown in FIGS. 1 and 2, you only see 3 or 4 dial graduations at one time because the L shaped dial cover 6 is transparent only where the 3 or 4 lines on the dial can be seen and also where a reference point arrow 8, shown in FIGS. 1 and 3, can be seen.

How To Open Lock

To open lock if combination is 34-35-25 first pull slowly on rope 2 with two knots 7 all the way until the rope 2 with one knot 7 is all the way against rope pulling hole 11, change ropes, Pull slowly on rope with one knot until both ropes are about even and stop.Look into view hole 10 and pull slowly on rope with one knot and stop when wide line 5 lines up with reference point arrow 8, keep pulling slowly counting each line as it goes past arrow 8 and count 34 lines and stop. Change ropes and pull slowly back to wide line 5 using rope with two knots and stop. Keep pulling slowly on rope with two knots counting each line as it goes past arrow 8, count 35 lines and stop.

Change ropes pull slowly on rope with one knot counting each line as it goes by arrow 8 and count 25 lines and stop, open lock.

How To Find Which Line To Make Wide 5

To find which line to make wide 5 on a 40 line, 3 number dial combination lock and also a new 3 number combination when the original combination is 10-39-14 for example, you must take certain steps. Original combination is turn clockwise 3 turns and stop at 10. Turn counter-clockwise past 0 and stop at 39. Turn clockwise and stop at 14, open lock. To find new combination add 5 to second number of original combination which is 39+5=4.4 is the line that you make wide 5. Turn clockwise 3 turns and stop at 4, wide line on dial 5, keep turning clockwise and count each line until you get to 10.34 lines counted makes 34 new first number on new combination. Turn counter-clockwise and stop 4, wide line on dial 5. Keep turning counter-clockwise and count each line until you get to 39.35 lines counted makes 35 new second number on new combination. Now start counting lines as you turn clockwise and stop at 14.25 lines counted makes 25 new third number on new combination. New combination is 34-35-25.

If you get to the 4, wide line on dial 5, before you get to third number, then you must start counting from the 4, wide line on dial 5, until you get to the third number and the number of lines counted would be the new third number.

SUMMARY, RAMIFICATIONS, AND SCOPE

Accordingly, the reader will see that the present invention is very hard, if not impossible, to open if you are drunk. By mounting the present invention on a common dial combination lock which has a steel shackle and by drilling a hole through a common anti-theft bar, that fits on a automobile steering wheel I am able to put this present invention on it which makes the present invention more convenient to use.

Although the description above contains many specificities these should not be construed as limiting the scope of the invention but as merely providing illustrations of some of the presently preferred embodiments of this invention. For example, the dome cover can have other shapes, such as square, hexagon, flat top, etc.; the view hole can have other shapes; there could be a hole added for a light; the rope can be a steel cable; there could be more than one rope pulling hole, etc.

Thus the scope of the invention should be determined by the appended claims and their legal equivalents, rather than by examples given.

I claim:

1. A view limiting enclosure and assembly for dial combination locks, comprising:

(a) a cover that can not be opened up that completely covers a dial combination lock dial and dial turn-knob except for two holes,a dial viewing hole, to view a limited number of dial graduations as they pass by a reference point and a dial knob turning hole, (b) a means for turning a dial knob from outside of said cover several turns clockwise and several turns counter-clockwise through said dial knob turning hole, (c) a dial with no visible numbers and all the dial graduations appear the same except for one dial graduation, whereby, to open, the lock each dial graduation would have to be counted one at a time,thereby making it very difficult to open if a person is under the influence of alcohol.

* * * * *